US007296524B2

(12) United States Patent
Beverly

(10) Patent No.: US 7,296,524 B2
(45) Date of Patent: Nov. 20, 2007

(54) TUFTING MACHINE

(75) Inventor: Ian Beverly, Blackburn (GB)

(73) Assignee: Spencer Wright Industries, Inc., Dalton, GA (US)

( * ) Notice: Subject to any disclaimer, the term of this patent is extended or adjusted under 35 U.S.C. 154(b) by 745 days.

(21) Appl. No.: 10/642,957

(22) Filed: Aug. 18, 2003

(65) Prior Publication Data

US 2005/0066867 A1 Mar. 31, 2005

(51) Int. Cl.
*D05C 15/14* (2006.01)
*D05C 15/00* (2006.01)

(52) U.S. Cl. ..... 112/80.3

(58) Field of Classification Search ..... 112/80.01, 112/80.3, 80.4, 80.45, 80.5, 80.51, 80.52, 112/80.54, 80.55, 80.7, 80.71
See application file for complete search history.

(56) References Cited

U.S. PATENT DOCUMENTS 2,842,080 A * 7/1958 Hoeselbarth ..... 112/80.53
3,152,563 A * 10/1964 Broadrick ..... 112/80.55
3,324,812 A * 6/1967 Smith ..... 112/80.55
3,677,206 A * 7/1972 MacIsaac et al. ..... 112/80.52
4,029,029 A * 6/1977 Franks et al. ..... 112/80.53
4,840,133 A * 6/1989 Watkins ..... 112/80.3
5,357,886 A * 10/1994 Piller ..... 112/80.4
6,269,759 B1 * 8/2001 Zafiroglu et al. ..... 112/80.01
7,107,918 B2 * 9/2006 Caylor et al. ..... 112/80.45

* cited by examiner

*Primary Examiner*—Ismael Izaguirre
(74) *Attorney, Agent, or Firm*—Stephen J. Stark; Alan Ruderman

(57) ABSTRACT

A tufting machine for producing pile fabric having a pile height of approximately at least 50 mm has divider plates between adjacent needles to prevent yarn loops and especially the legs of cut loops from becoming trapped between an adjacent needle and its associated yarn feed. The divider plates may take the form of plates forming an extension of the fingers of the needle plate between each pair of which a needle reciprocates and may be mounted on a block on the bed plate beneath the needle plate, or may be plates upstanding from the hook bar.

8 Claims, 4 Drawing Sheets

TUFTING MACHINE

BACKGROUND OF THE INVENTION

The present invention relates to tufting machines, and in particular, to tufting machines capable of producing a high-pile tufted product. Such machines may be used to produce artificial grass, and have been used to produce shag carpet.

During the tufting of a high-pile, cut pile material, the tuft legs of the yarn become extremely lively or springy immediately after being cut. This is particularly true in regard to polypropylene yarns. Accordingly, the free ends often may be pulled back through the backing material as they become trapped between neighboring needles and their associated yarn feed. Additionally, the cut yarn may enter the adjacent needle eye, and sometimes the adjacent needle may even sew through a previously formed loop in the case of loop pile. When any of these events occur, there is an obvious visual defect in the product.

According to the present invention, a tufting machine is provided which comprises a plurality of aligned needles arranged to reciprocate in a direction which, in use, is perpendicular to a backing material which is progressively fed through the machine; the machine having a hook associated with each needle oscillatably moveable, in use, to pick up yarn from its associated needle, a loop engaging surface of the hook being, in use, at least 50 mm below the backing material, and wherein each tuft is isolated from a tuft formed by an adjacent needle by a dividing plate which extends in the direction of needle reciprocation for at least 20% of the distance between the backing cloth and the loop engaging surface of the hooks.

By extending to this degree, the dividing plates prevent the free ends of yarn from coming into contact with neighboring needles.

Preferably, at least a major portion of each dividing plate is closer to its respective hook than to the backing material, as this is where the free ends of the yarn are formed.

Preferably, each dividing plate extends, i.e., has dimension in the direction of needle reciprocation, at least 30%, more preferably at least 50%, and possibly as much as 80% of the distance between the backing material and the loop engaging surface of the hooks.

Conventional tufting machines have a needle or reed plate which is essentially a series of fingers which support the backing material, between which fingers the needles penetrate during reciprocation. In one embodiment of the invention, the dividing plates may be extensions of the needle plate reed fingers. The tufting machine is provided with a support block on the bed plate on which the needle plate fingers, among other things, are mounted. The dividing plates may alternatively extend from the support block.

As a further alternative, the dividing plates may be mounted on a hook bar on which the hooks are mounted. However, in this case, the dividing plates would oscillate with the hooks.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
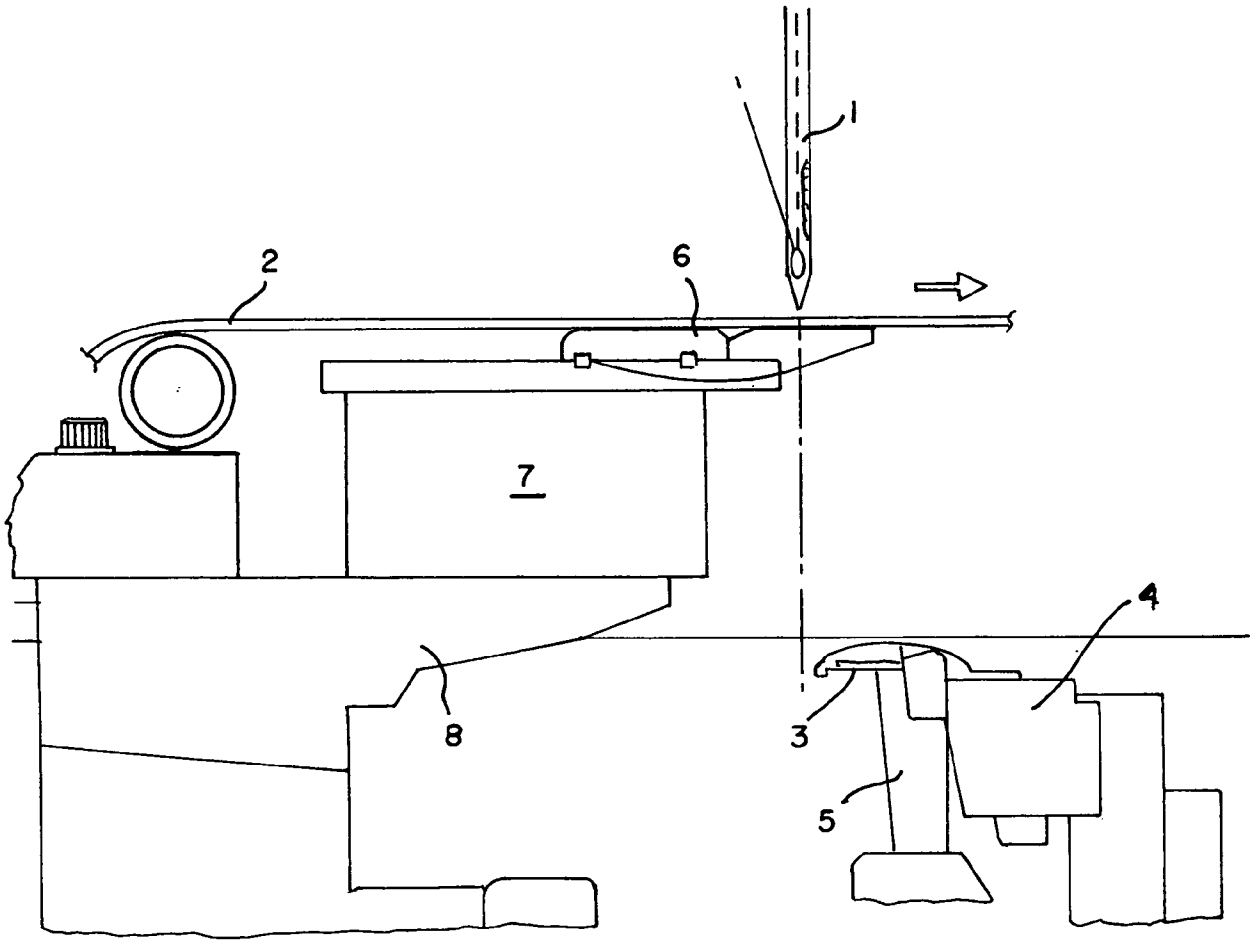
FIG.1 PRIOR ART
FIG. 1 is a schematic elevational view of a conventional tufting machine.

The components of a tufting machine as shown in FIG. 1 are well known in the art. The tufting machine has a plurality of needles 1 arranged in at least one row perpendicular to the plane of FIG. 1 which reciprocate vertically. A backing material 2 passes through the machine, in this case, since the machine is a cut-pile tufting machine, from left to right perpendicular to the direction of needle reciprocation. A hook 3 associated with each needle is provided below the backing material on a hook bar 4 which reciprocates or more correctly oscillates the hook in a generally horizontal sense. A knife 5 in a cut-pile machine oscillates with respect to each hook to cut the loops of yarn formed on the hook. The present invention is also applicable to loop pile machines (i.e., where no knives are provided and the hooks 5 are replaced with loopers) which seize and shed the loops since the hook faces the opposite direction to that illustrated in FIG. 1. However, in this case, the movement of the ends of the loops is less of a problem as the loops are less lively when shed from the loopers than are the legs of cut pile.

A needle plate 6 having a plurality of spaced apart reeds or fingers 26 is mounted beneath the backing material 2. This serves to support the backing material 2 at the point of needle penetration and takes the form wherein the plurality of fingers 26 is arranged perpendicular to the plane of FIG. 1 so that each needle 1 can penetrate between a pair of fingers. The needle plate 6 is supported on a support block 7 mounted on the bed plate 8 of the bed of the tufting machine.

The one unconventional feature of FIG. 1 is the separation between the backing material 2 and the hooks 3. In this case, the separation is approximately 70 mm as this is the approximate required pile height of the tufted material. Such material is particularly applicable to artificial grass products. High pile machines are generally considered to be those having a pile of 50 mm and above. Artificial grass machines also tend to be relatively course gauges (5/16" and above). These machines use polypropylene yarn and the free ends of this become extremely lively or springy when they are cut. These free ends readily become caught between an adjacent needle and its yarn feed and can be pulled back up through the backing material.

Figure 2:
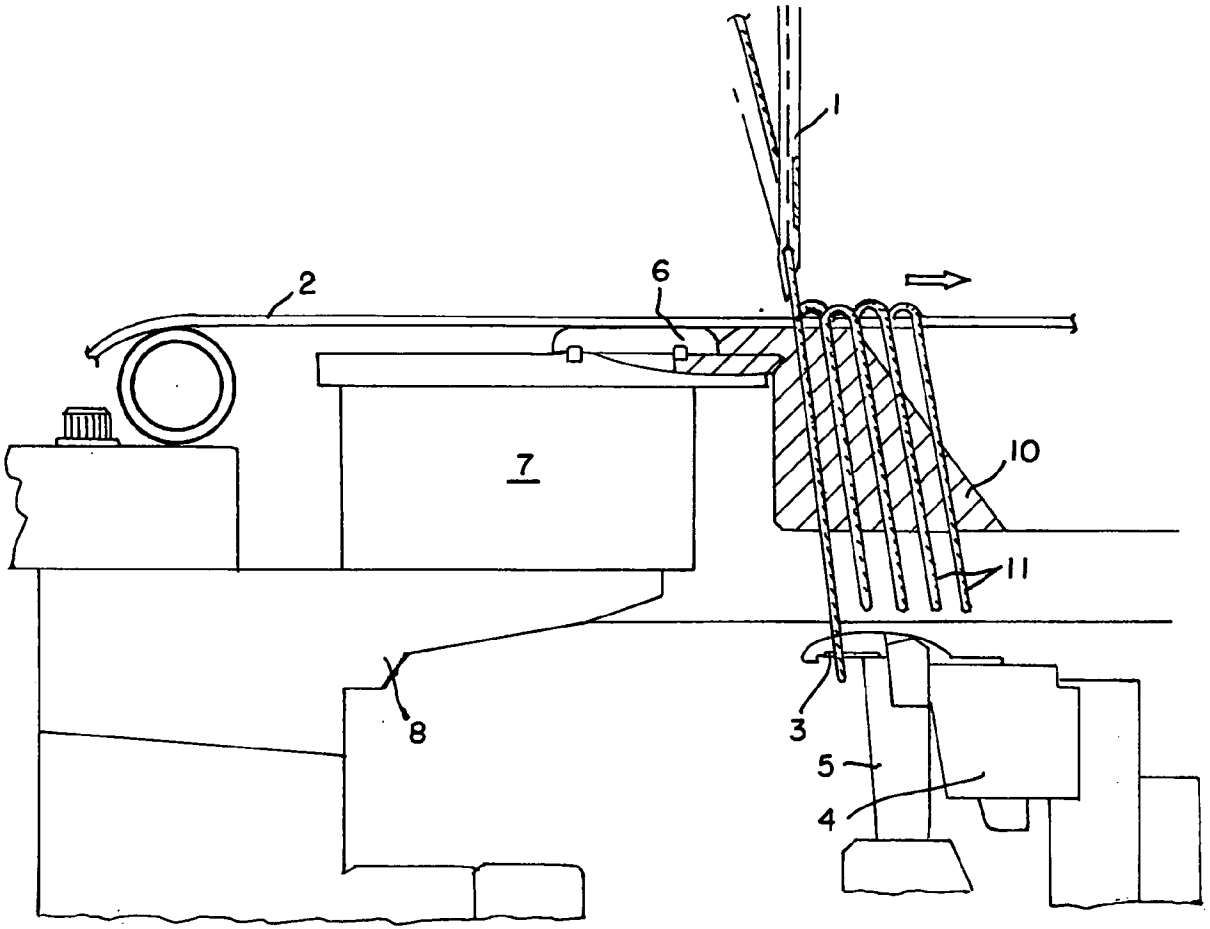
FIG. 2 is a similar view of a first embodiment of the present invention.

A first embodiment of the present invention is shown in FIG. 2 where a divider plate 10 is provided, the divider plate 10 here being an enlarged extension of the needle plate 6 in lieu of the needle plate fingers. Thus, the divider plate 10 is provided between each pair of needles. The divider plate extends down approximately 70% of the distance from the backing material towards the top of the hook. The plate 10 preferably is flared outwardly in the direction towards the hook and at its lowest surface, has a width of approximately six times the length of the back stitch. As will be appreciated from FIG. 2, the divider plate 10 prevents the free ends 11 of the cut tufts from moving sideways and coming into contact with adjacent needles.

Figure 3:
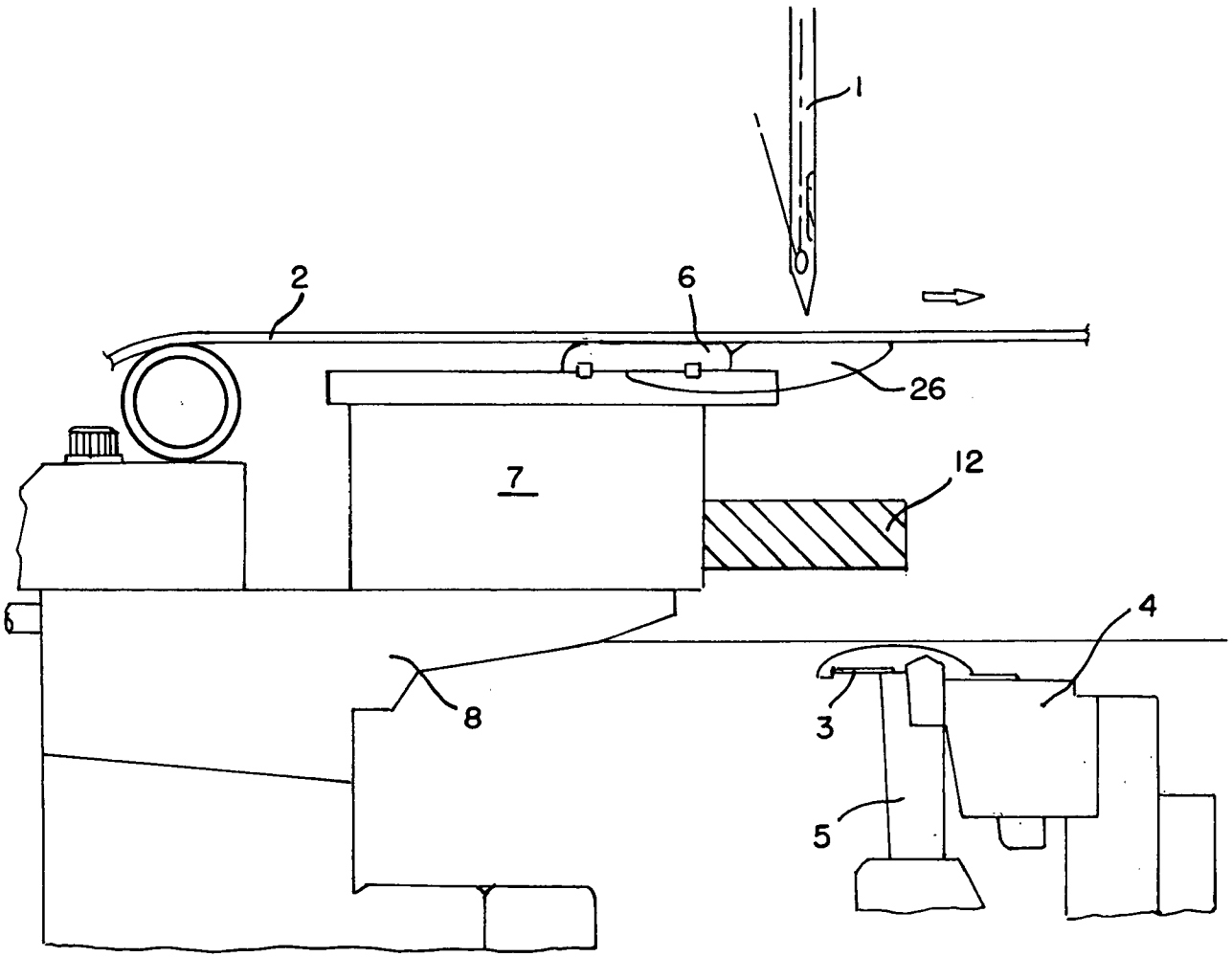
FIG. 3 is a similar view of a second embodiment of the present invention.

The embodiment illustrated in FIG. 3 is similar to that in FIG. 2, except that this arrangement has a conventional needle plate 6 and needle plate fingers 26 and the divider plates 12 extend out of the support block 7 a distance that preferably is beyond that of the needle plate fingers 26 as illustrated. In this case, the height of a divider plate is approximately 20% of the distance from the backing material 2 to the top of the hook 3.

Figure 4:
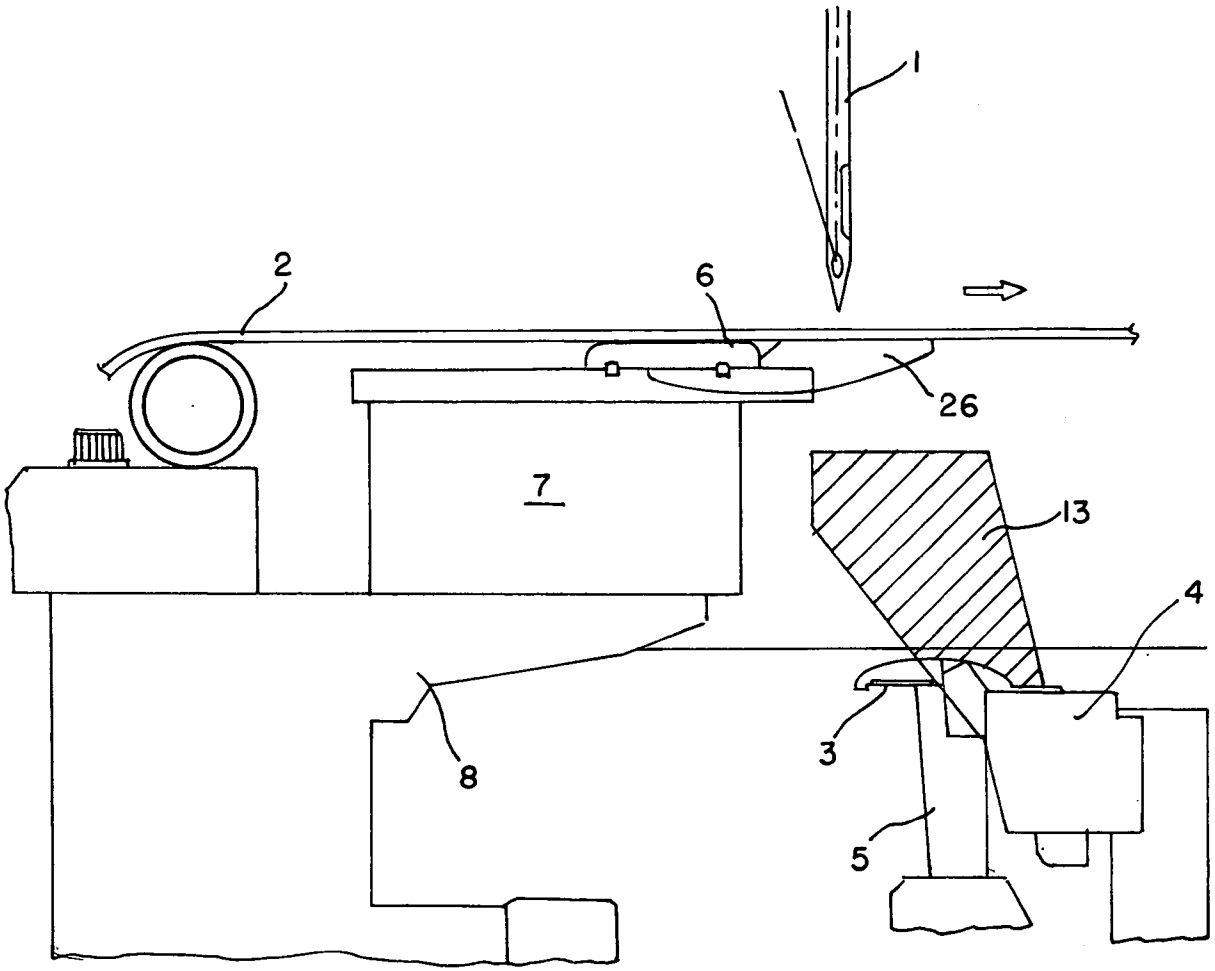
FIG. 4 is a similar view of a third embodiment of the present invention.

In the embodiment illustrated in FIG. 4, there is again a conventional needle plate, but this time the divider plates 13 extend up from the hook bar 4. In this case, the divider plate 13 is preferably flared upwardly towards the backing material 2.

In use the divider plates provide a separator to prevent yarn loops in loop pile machines and the legs of the cut loops in cut pile machines from becoming trapped by an adjacent needle and associated yarn feed, and thereby precludes the free end of cut loop yarns from being pulled back through the backing material and also from entering the eye of an adjacent needle.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

The invention claimed is:

1. A tufting machine comprising; a plurality of aligned needles arranged to reciprocate in a direction which, in use, is perpendicular to a backing material which is progressively fed through the machine; a hook associated with each needle which is oscillatedly moveable, in use, to pick up yarn from its associated needle, a loop engaging surface of the hook being below the backing material; wherein each tuft is isolated from a tuft formed by an adjacent needle by a divider plate which extends in the direction of needle reciprocation for at least 20% of the distance between the backing material and the loop engaging surface of the hooks with each divider plate extending from at least one of reed fingers of a needle plate and a support block connected to a bed plate located below the needle plate.

2. A tufting machine according to claim 1, wherein each divider plate extends for at least 30% of the distance between the backing material and the loop engaging surface of the hook.

3. A machine according to claim 1, wherein each divider plate extends for up to 80% of the distance between the backing cloth and the loop engaging surface of the hook.

4. In a tufting machine comprising a plurality of aligned needles arranged to reciprocate in a direction which, in use, is perpendicular to a backing material which is progressively fed through the machine; a hook associated with each needle which is oscillatedly moveable, in use, to pick up yarn from its associated needle, a loop engaging surface of the hook being, in use, at least 50 mm below the backing material; wherein each tuft is isolated from a tuft formed by an adjacent needle by a divider plate which extends in the direction of needle reciprocation for at least 20% of the distance between the backing material and the loop engaging surface of the hooks with each divider plate extends from at least 30% of a distance between the backing material and the loop engaging surface of the hook; and further comprising a needle plate having a series of reed fingers and each divider plate is an extension of a respective reed finger.

5. A machine according to claim 4, wherein each divider plate extends for up to 80% of the distance between the backing cloth and the loop engaging surface of the hook.

6. A tufting machine as recited in claim 4, wherein said divider plate is enlarged at an end adjacent said hooks relative to an end adjacent said needle plate.

7. In a tufting machine comprising; a plurality of aligned needles arranged to reciprocate in a direction which, in use, is perpendicular to a backing material which is progressively fed through the machine; a hook associated with each needle which is oscillatedly moveable, in use, to pick up yarn from its associated needle, a loop engaging surface of the hook being, in use, at least 50 mm below the backing material; wherein each tuft is isolated from a tuft formed by an adjacent needle by a divider plate which extends in the direction of needle reciprocation for at least 20% of the distance between the backing material and the loop engaging surface of the hooks with each divider plate extends from at least 30% of a distance between the backing material and the loop engaging surface of the hook; and further comprising a needle plate including a series of reed fingers between each pair of which a needle reciprocates, a bed plate located beneath the needle plate, and a support block carried by the bed plate and the divider plates extend from the support block.

8. A tufting machine as recited in claim 7, wherein said divider plate is enlarged at an end spaced remote from said hooks relative to an end adjacent said hooks.

* * * * *